US005207161A

United States Patent [19]

Pileggi et al.

[11] Patent Number: 5,207,161

[45] Date of Patent: May 4, 1993

[54] SIDE BEARING ARRANGEMENT FOR MULTI-UNIT RAILROAD CARS WITH DIFFERENT SIDE BEARINGS ON ADJACENT CAR ENDS SHARING A COMMON TRUCK

[75] Inventors: James D. Pileggi, Beaverton; Jon B. Zaerr, Portland, both of Oreg.

[73] Assignee: Gunderson, Inc., Portland, Oreg.

[21] Appl. No.: 919,712

[22] Filed: Jul. 24, 1992

[51] Int. Cl.[5] ..... B61F 5/14

[52] U.S. Cl. ..... 105/4.1; 105/199.3

[58] Field of Search ..... 105/4.1, 199.3, 199.4; 213/75 R

[56] References Cited

U.S. PATENT DOCUMENTS

| | | | |
|---|---|---|---|
| 2,073,013 | 3/1937 | Jabelman | 105/4.1 |
| 3,399,631 | 9/1968 | Weber | 105/4.1 |
| 4,315,465 | 2/1982 | Cordani et al. | 105/4.1 |
| 4,751,882 | 6/1988 | Wheatley et al. | 105/4.1 |

*Primary Examiner*—Robert J. Oberleitner
*Assistant Examiner*—S. Joseph Morano
*Attorney, Agent, or Firm*—Chernoff, Vilhauer, McClung & Stenzel

[57] ABSTRACT

A multi-unit railroad car has adjacent ends of adjacent car units carried upon a shared truck and interconnected by an articulating coupling having a female part attached to one of the car units and a male part attached to the other of the car units. Side bearings for carrying loads generated by the car unit whose end has the female coupling part are of an anti-friction type, and side bearings associated with the car unit whose end has the male coupling part are of a constant-contact, limited-friction type so that turning moments exerted by the car units on the shared truck are kept within a desirable range and are kept balanced against each other to avoid either one of the articulated interconnected car units from adversely steering the shared truck during a curve.

10 Claims, 5 Drawing Sheets

SIDE BEARING ARRANGEMENT FOR MULTI-UNIT RAILROAD CARS WITH DIFFERENT SIDE BEARINGS ON ADJACENT CAR ENDS SHARING A COMMON TRUCK

BACKGROUND OF THE INVENTION

The present invention relates to articulated multi-unit railroad cars, and in particular to side bearing arrangements associated with a shared truck supporting a pair of adjacent car units.

In some multi-unit freight cars a shared truck supports an end of each of a pair of adjacent car units which are connected to each other and to the shared truck by an articulating coupling. Such a shared truck has a generally vertical turning axis, and much of the weight of the respective end of each of the adjacent car units is carried to the shared truck through a center bearing where the articulating coupling interconnecting the two car units with each other rests atop a member of the shared truck, usually a transversely oriented truck bolster. Side bearings, located laterally outward from the center bearing, may carry a portion of the weight of each car unit to the shared truck.

In the past, articulated multi-unit rail cars have utilized shared trucks, with adjacent car units interconnected by articulating couplings including respective male and female portions. Various arrangements of side bearings for articulated multi-unit railway cars are also shown in Weber U.S. Pat. No. 3,399,631, and Adams et al. U.S. Pat. No. 4,233,909, which show similar side bearings for each of a pair of car units carried by a single shared truck.

Friction generated in the center bearing and the side bearings resists turning movement of such a shared truck relative to the adjacent car units. A certain amount of friction is desirable to prevent a shared truck from turning too easily with respect to the adjacent car units when such a multi-unit railroad car is traveling along tangent track, especially when the railroad car is unloaded, since a side-to-side harmonic oscillation of the car, called hunting, may result from the truck turning too easily, and may ultimately cause derailment of such a car.

Also important, however, is that with each shared truck of an articulated multi-unit railroad car having to carry heavy loads, as the individual car units are loaded, for example, with long cargo containers stacked one upon another, the friction generated in the center bearings and side bearings of a shared truck is able to cause an undesirably great amount of resistance to turning the shared truck relative to the car units, so that the total truck turning moment required to cause the truck to turn relative to the car units, in order to follow curvature of the railroad track, is too great, and excessive forces may be transmitted to the truck structure. The occurrence of these high forces appears to be more likely in heavily loaded cars traveling at low speed and entering curved track where one rail is superelevated than at other times.

What is needed, then, is a bearing arrangement, for transferring loads from the respective interconnected ends of a pair of adjacent car units to a shared truck in an articulated multi-unit railroad car, which results in the shared truck being able to follow curved track at various speeds without transmitting excessive forces or spreading apart the rails of the track when the car is heavily laden, yet without excessive hunting when the car is operated empty.

SUMMARY OF THE INVENTION

The present invention overcomes the aforementioned shortcomings of previously known articulated multi-unit railroad cars by providing a bearing arrangement, between adjacent car units interconnected with each other and a shared truck supporting the respective ends of the adjacent car units, which produces an amount of resistance to turning, directly between the shared truck and each of the adjacent car units carried by the shared truck, requiring a turning moment of similar magnitude to turn the shared truck with respect to either of the car units supported by it.

In a preferred embodiment of the invention, a female portion of an articulated coupling, supported atop a shared truck by a center bearing, supports the respective end of one of the adjacent car units, and the side bearings associated with that end of that car unit are of a single-roller type producing a very small frictional resistance to turning of the shared truck with respect to that car unit. The adjacent car unit, whose respective end is partly supported through the female part of the articulating coupling by a male part of the articulating coupling interconnecting the two adjacent car units, has side bearings of the roller-assisted constant-contact type producing a definite, but limited, amount of friction between that car unit and the shared truck. The side bearings of both sets are carried by the shared truck and the ones of each set are, in a preferred embodiment of the invention, laterally separated from each other and equally spaced apart from the center bearing, in order to provide roll stability of the car body. In a preferred embodiment of the invention, the turning moment required to turn the shared truck by overcoming the friction in the center bearing and the single-roller side bearings is about equal to the turning moment required to turn the shared truck by overcoming the friction between the roller-assisted constant-contact side bearings and the car unit having the male part of the articulating coupling, so that neither of the adjacent car units creates a controlling or excessively dominant effect on the ability of the shared truck to turn, about a vertical truck turning axis, with respect to the two adjacent car units supported by the shared truck.

In a preferred embodiment of the invention the total turning moment required to turn the truck with respect to both of the adjacent car units whose respective ends are supported by the shared truck is kept sufficiently small that the truck is free to follow the curvature of the track along which the car is traveling, without causing excessive rail-spreading forces to be generated. At the same time, a sufficient total amount of frictional resistance to turning of the shared truck with respect to both of the interconnected car units is provided to prevent excessive directional hunting of the shared truck. Such resistance to turning, provided to prevent hunting, may be provided in various conceivable ways, but is advantageously provided by the combination of center bearing and side bearings utilized between the car units and a shared truck.

It is therefore a principal object of the present invention to provide an improved bearing arrangement for use in connection with articulating couplings and shared trucks in a multi-unit articulated railroad car.

It is a feature of one preferred embodiment of the present invention that it includes roller-assisted constant-contact side bearings on a car unit connected to a shared truck by a male portion of an articulating coupling, in combination with friction-minimizing side bearings on the other of a pair of interconnected car units, with such other of the pair of car units supported by a female part of the articulating coupling interconnecting the car units, in a friction-producing center bearing atop the shared truck.

The foregoing and other objectives, features, and advantages of the invention will be more readily understood upon consideration of the following detailed description of the invention, taken in conjunction with the accompanying drawings.

PREFERRED EMBODIMENT OF THE INVENTION

Figure 1:
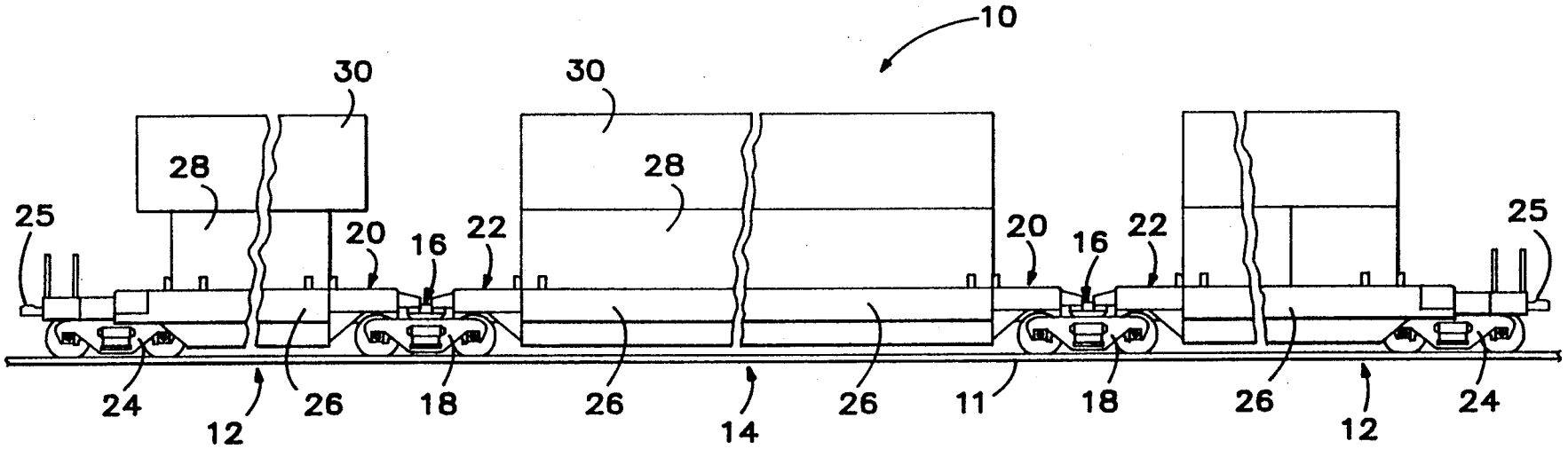
FIG. 1 is a side elevational view of a multi-unit railroad freight car embodying the present invention, with some of the car units shown foreshortened.
Figure 2:
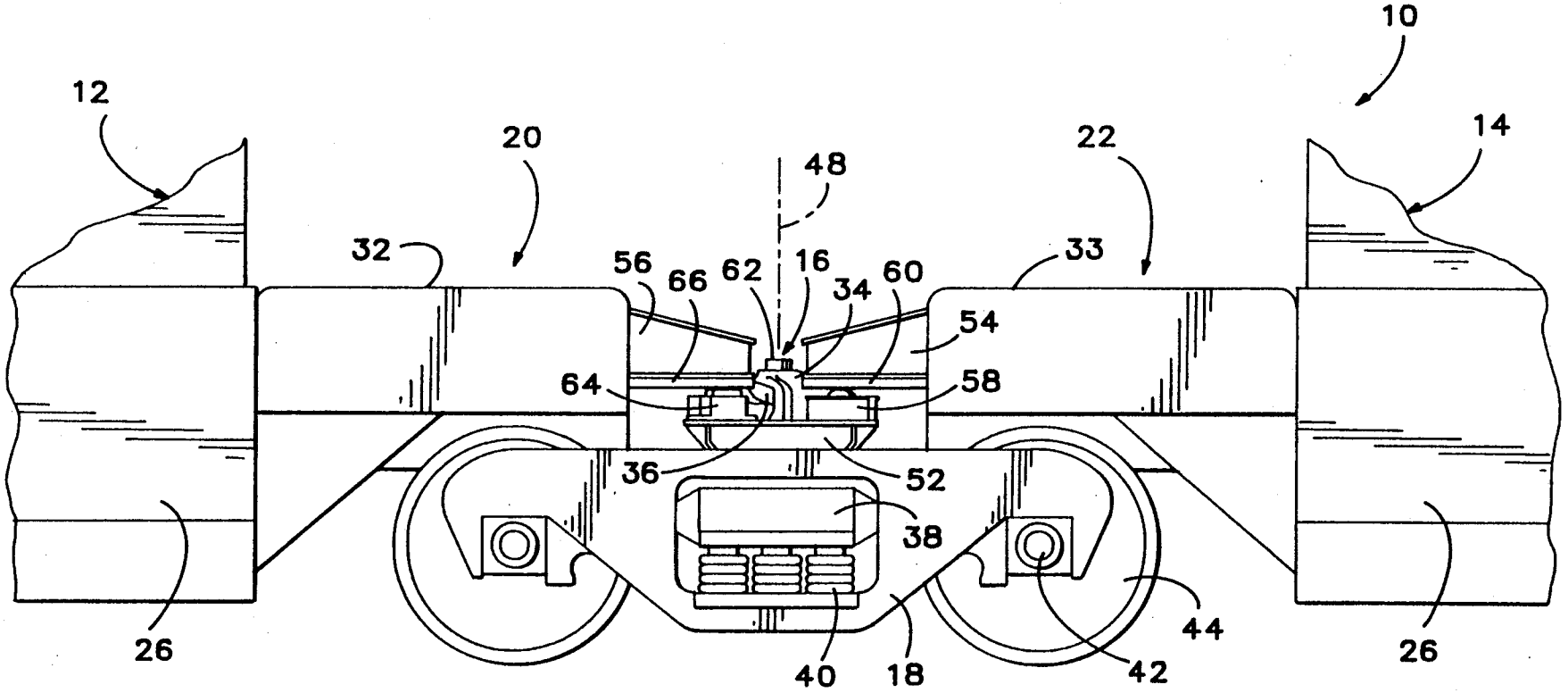
FIG. 2 is a side elevational view of a portion of the articulated multi-unit railroad freight car shown in FIG. 1, showing a pair of adjacent car units and a shared truck supporting the respective ends of the car-units at an enlarged scale.
Figure 3:
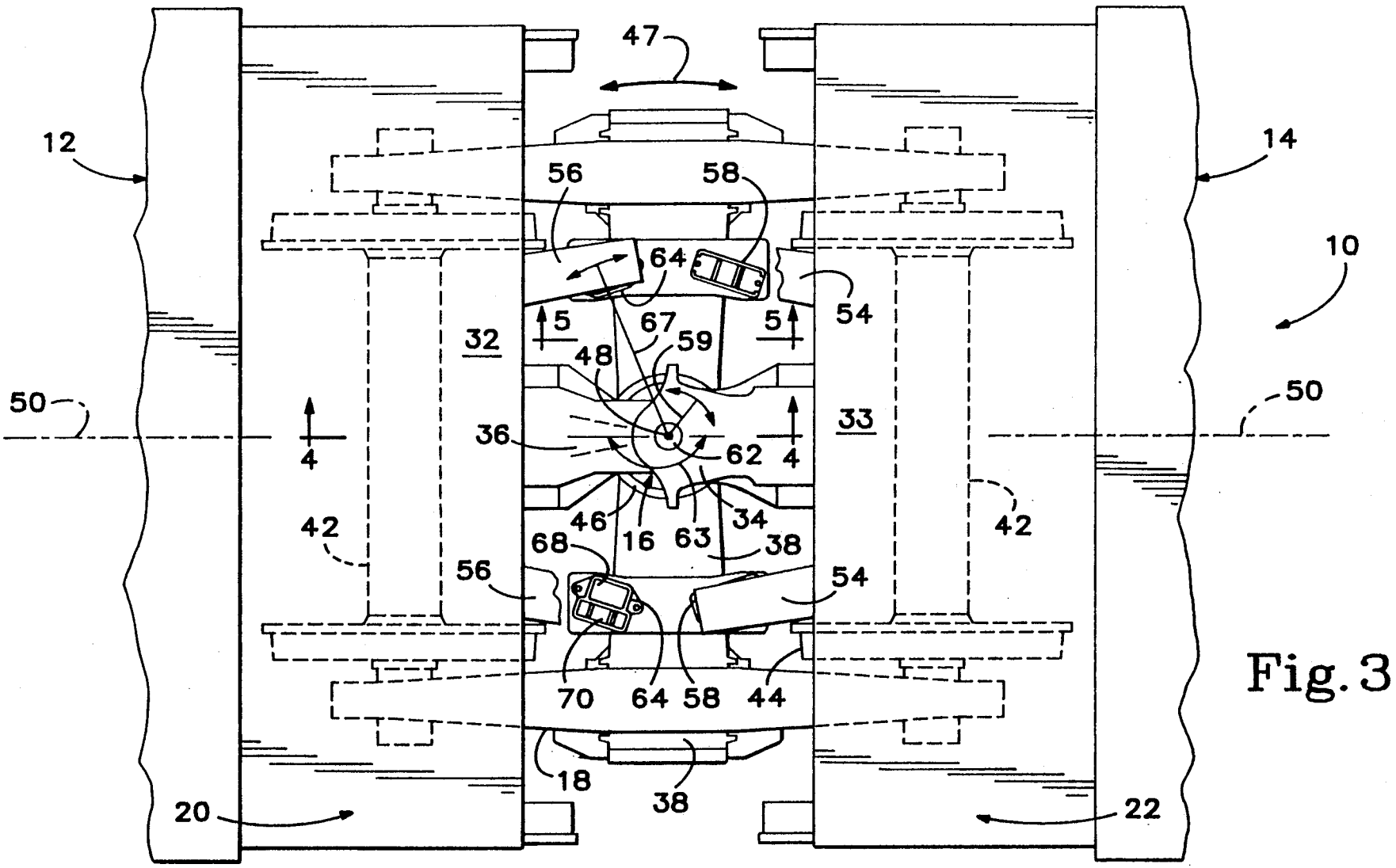
FIG. 3 is a top plan view showing the portion of an articulated multi-unit railroad freight car shown in FIG. 2.
Figure 4:
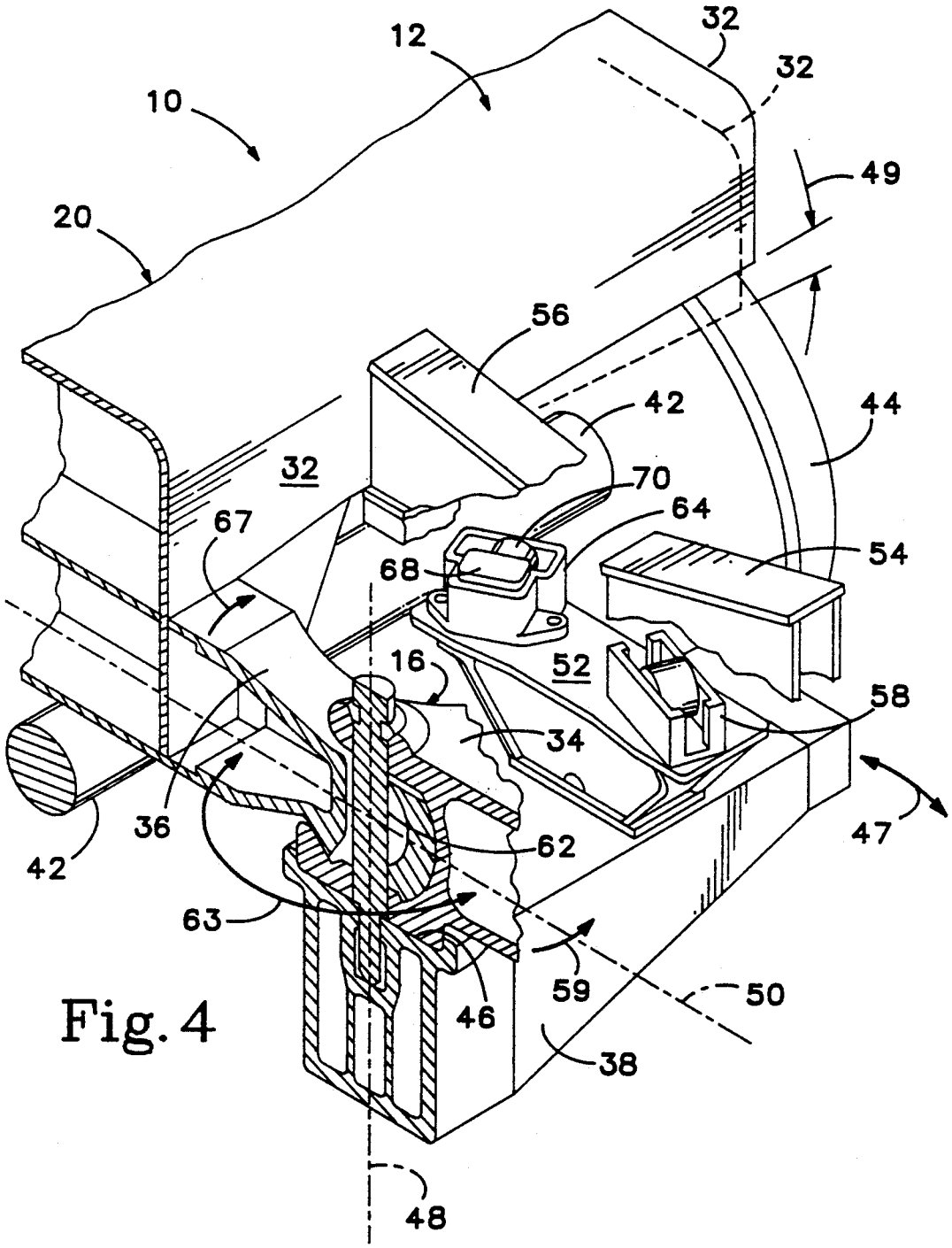
FIG. 4 is a fragmentary, partially sectional, partially cut-away view of the portion of a railroad car shown in FIG. 3, taken along line 4—4 of FIG. 3.
Figure 5:
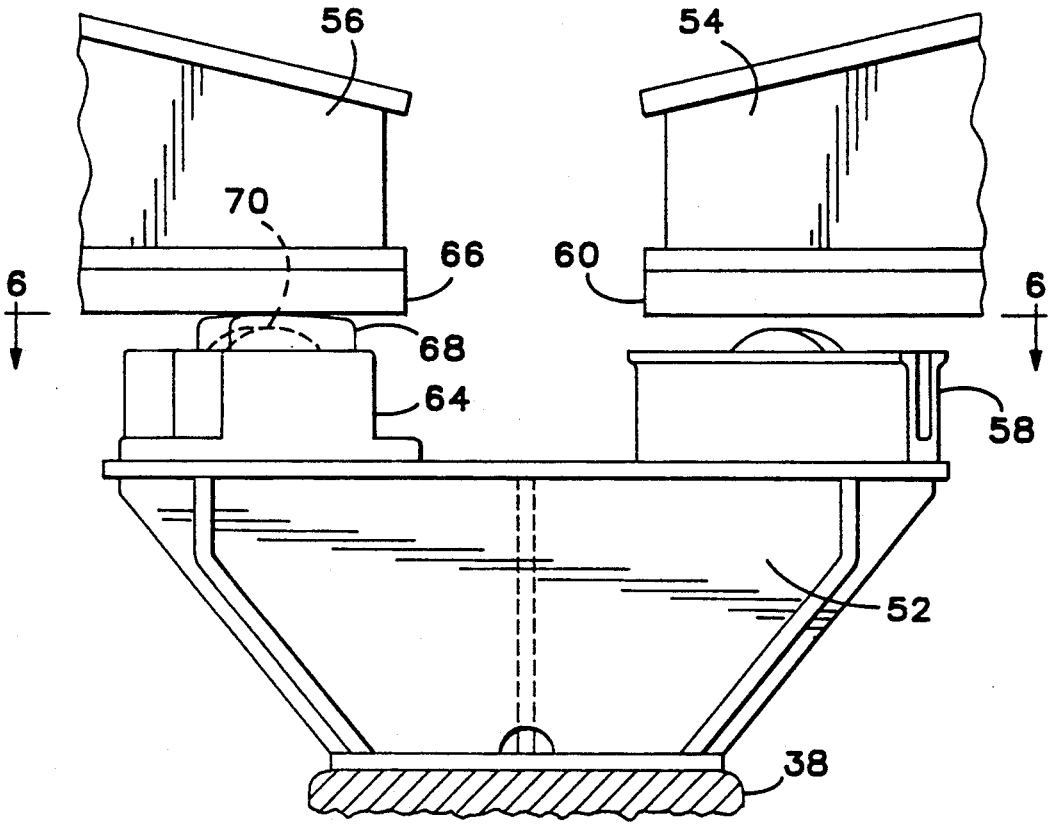
FIG. 5 is a detail view, at an enlarged scale, showing a side bearing foundation and portions of the car units shown in FIG. 2, taken along line 5—5.
Figure 6:
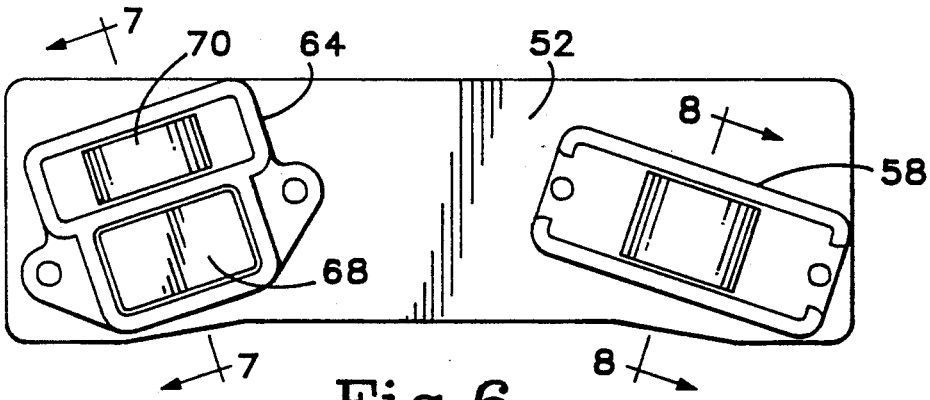
FIG. 6 is a top plan view of the side bearing foundation and side bearings shown in FIG. 5, taken in the direction indicated by line 6—6 of FIG. 5.
Figure 7:
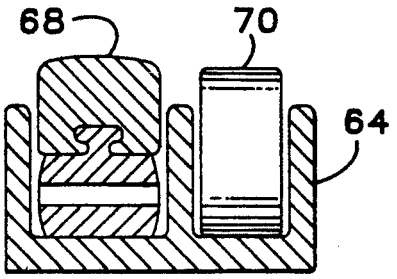
FIG. 7 is a sectional view of one of the side bearings shown in FIGS. 5 and 6, taken along line 7—7 of FIG. 6.
Figure 8:
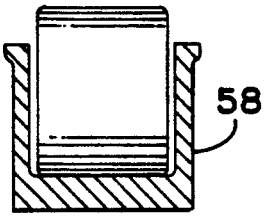
FIG. 8 is a sectional view of one of the side bearings shown in FIGS. 5 and 6, taken along line 8—8 of FIG. 6.

Referring now to the drawings which are a part of the disclosure herein, a multi-unit car 10 located on a railroad track 11 has a pair of end units 12 at opposite ends of the car 10, and may further include one or more intermediate car units 14. All of the car units 12 and 14 are arranged end-to-end and interconnected with one another by articulating couplings 16. As shown in FIGS. 2–4, a shared truck 18 supports the weight of the respective ends 20, 22 of adjacent car units. Additional shared trucks 18 (not shown) and additional intermediate car units 14 may be similarly interconnected as part of the multi-unit car 10, as suggested by the break in the middle of the intermediate car unit 14 shown in FIG. 1. A respective unshared truck 24 supports one end of each of the end car units 12, where a conventional coupler 25 is provided to couple the car 10 into a train.

Each of the car units 12 and 14 includes a body 26 defining a well to receive one or more cargo containers 28, and a container 30 may be stacked atop the containers 28 in each car unit 12 or 14 as an upper tier. A fully laden, multi-unit car 10 having two end car units 12 and three intermediate car units 14 thus may have a gross weight of about 800,000 pounds. Accordingly, in a preferred embodiment of the invention the shared trucks 18 are nominally 125-Ton trucks.

Referring next more particularly to FIGS. 2–4, a pair of interconnected ends 20 and 22 of a pair of adjacent car units 12 and 14 include body bolsters 32 and 33, as respective parts of the end car unit 12 and the intermediate car unit 14. The articulating coupling 16, for example, a well-known articulating connector available from American Steel Foundries, of Chicago, Ill., is shown generally, and includes a female part 34 fixedly attached to the body bolster 33 of the car end 22 of the intermediate car unit 14. A male part 36 of the articulating coupling 16 is fixedly attached to the body bolster 32 of the end car unit 12, as may be seen in FIGS. 2, 3 and 4. Similarly, an articulating coupling 16 including a female part 34 and a male part 36 would be associated with the adjacent ends of each pair of intermediate car units 14 adjacent one another, and is associated with the shared truck 18 between the end car unit 12 and the intermediate car unit 14 at the opposite end of the multi-unit car 10.

Ordinarily, but not necessarily, a female articulating coupling part 34 is located at one end and a male articulating coupling part 36 is located at the other end of each of the intermediate car units 14 of the multi-unit car 10, so that all of the car units are interconnected at the respective shared trucks 18 with all of the female parts 34 extending toward the same end of the multi-unit car 10.

Each shared truck 18 includes a horizontal, transversely-oriented truck bolster 38 supported by respective springs 40 which permit a certain amount of freedom of movement of the truck bolster 38 with respect to the axles 42 on which the wheels 44 of the truck are mounted. A center bearing 46 is located centrally atop the truck bolster 38, and the female part 34 of the articulating coupling 16 rests in and is supported atop the truck bolster 38 by the center bearing 46. Atop the shared truck 18 shown in FIGS. 2–4, the center bearing 46 supports at least a portion of the weight of the intermediate car unit 14, which is transferred to the center bearing 46 through the female part 34 of the articulating coupling 16. The center bearing 46 permits the shared truck 18 to rotate, that is, to be turned to follow the rails of the track 11, with respect to the articulating coupling 16, as indicated by the arrow 47 and defines a generally vertical truck turning axis 48.

It will be appreciated that the truck turning axis 48 will not always be precisely vertical, depending upon the inclination of and the relative heights of the rails of a railroad track 11 on which the car 10 is located, and depending also upon the amount of car body lean, as indicated by the arrow 49, and any resultant vertical displacement of one or the other end of the truck bolster 38 with respect to the frame of the shared truck 18, so that the bodies 26 of the car units 12 and 14 are displaced about respective horizontal axes 50 extending longitudinally of the respective car units 12 and 14 supported by a shared truck 18. Similar displacement, to a smaller degree, of the truck turning axis 48 from the vertical in a forward or rearward direction is also possible as a result of slope along the track 11 but the precise orientation of the truck turning axis 48 of each shared truck 18 is not of critical importance.

Spaced apart laterally of the car 10 from the center bearing 46, on each side of the center bearing, a respective side bearing foundation 52 is mounted atop the truck bolster 38. A pair of side bearing support arms 54 are attached to and extend generally longitudinally and divergently from the body bolster 33 generally toward the body bolster 32, each support arm 54 extending to terminate above a portion of the respective side bearing foundation 52. Similarly, a pair of side bearing support arms 56 are fixedly attached to the body bolster 32 of the end car unit 12 and extend generally longitudinally from the car 10 and divergently toward the intermediate car unit 14 in respective locations, each support arm 56 also terminating above a respective side bearing foundation 52.

A pair of single roller side bearings 58 are mounted atop the side bearing foundations 52 beneath the side bearing support arms 54 of the intermediate car unit 14. The single roller side bearings 58 are located so as to provide load-carrying support for the side bearing support arms 54 with respect to the side bearing foundations 52 while producing a minimum amount of frictional resistance to movement of the side bearing support arms 54 with respect to the side bearing foundations 52 when the shared truck 18 turns about the truck turning axis 48 with respect to the intermediate car unit 14, as the shared truck 18 follows the rails of the railroad track 11 on which it is riding. Rotation of the shared truck 18 about the truck turning axis 48 with respect to the intermediate car unit 14 to which the female part 34 of the articulating coupling 16 is attached is thus resisted frictionally substantially only by the friction generated in the center bearing 46, and the friction in the side bearings 58 is negligible when such single roller side bearings are utilized. A turning moment 59 (FIG. 3) is thus required to overcome the frictional resistance between the shared truck 18 and the female part 34 of the articulating coupling 16 and between the shared truck 18 and the side bearing support arms 54, through the center bearing 46 and the side bearings 58, respectively.

The side bearings 58 may, for example, be single roller side bearings of the type manufactured by and available from the A. Stucki Co. of Pittsburgh, Pa. as its model 656-C High Carbon Rolled Steel Truck Side Bearing. Such a bearing includes a roller having a diameter of 4 inches and a width of 3 inches mounted in a cage permitting a total rolling travel of about 4⅛ inches.

The single roller side bearings 58 are preferably mounted atop the side bearing foundation 52 in a position offset from the longitudinal center of the shared truck 18 toward the body bolster 33 and are preferably oriented in a radial mounting position. The side bearings 58 are preferably mounted to provide a small amount of clearance beneath each of the side bearing support arms 54 when the body 26 of the intermediate car unit 14 is not leaning with respect to the body bolster 38. An appropriate spacer or wear plate 60 may be provided on the underside of each of the side bearing support arms 54 to establish the desired amount of clearance and provide a surface of the required hardness and durability.

The male part 36 of the articulating coupling 16 is mated within the female part 34 of the articulating coupling 16, and the female and male parts 34 and 36 are prevented from separating from one another by a locking pin 62 which extends vertically into the truck bolster 38 at a location substantially coincident with the truck turning axis 48. The articulating coupling 16 permits a certain amount of rotational movement of the male part 36 with respect to the female part 34 about any axis, to accommodate curvature, dips, and rises in the track 11 over which the car 10 may be operated, but primarily permits rotation of the interconnected car units with respect to each other in a horizontal plane to define an angle 63 between the car units, about the truck turning axis 48. The male portion 36 of the articulating coupling carries most of the weight of the car unit 12 from the body bolster 32 on which it is mounted to the truck bolster 38, but does so only through the female part 34 of the articulating coupling 16. Thus, friction generated in the center bearing 46 does not oppose rotation of the truck 18 with respect directly to the car unit 12, which is supported by the male part 36 of the articulating coupling 16. Friction generated within the articulating coupling 16, between the male part 36 and the female part 34, resists changes in the angle 63 in a horizontal plane, between a pair of adjacent car units interconnected by such an articulating coupling 16, but movement of the car unit 12, supported by the male portion 36 of the articulating coupling 16, with respect to the shared truck 18, does not transmit any significant truck-turning moment through the articulating coupling 16 tending to turn the shared truck 18 to follow the car unit supported by the male part 36 of the articulating coupling 16.

In order to provide a truck turning moment about the truck turning axis 48 to tend to cause the shared truck 18 to follow movement of the car unit 12, with respect to the other car unit to which it is interconnected by the male part 36 of the articulating coupling 16, a pair of roller-assisted constant-contact side bearings 64 are mounted in respective positions atop the side bearing foundations 52, beneath the side bearing support arms 56. Bearing plates 66 and appropriate spacers are provided on the under side of each of the side bearing support arms 56 to preload each of the side bearing support arms 56 so that each carries a portion of the weight of the associated car unit 12 to the truck bolster 38 through the side bearings 64 and side bearing foundations 52. The side bearings 64 each provide frictional resistance to movement of the side bearing support arms 56 with respect to the side bearing foundations 52, to cause a truck turning moment 67, caused by friction directly between the shared truck 18 and the car unit having the male part 36 of the articulating coupling, to fall within a range of values. The upper limit of the truck turning moment 67 is established by load-carrying action of the roller portion of each such side bearing 64 when additional loading is transferred to a particular one of the side bearings 64 through the respective one of the support arms 56. The friction generated in the constant-contact portion 68 of the bearings 64 increases when loading in addition to the preload is assumed by the associated support arm 56, as when the car unit 12 negotiates a curve at a speed resulting in car body lean. However, such increase in friction is stopped when the roller 70 begins to support further increases in loads between the side-bearing foundation 52 and the support arm 56.

In a preferred embodiment of the invention, a roller-assisted constant-contact side bearing available from the W. H. Miner Division of Miner Enterprises, Inc., of Geneva, Ill., under the number TCC-4500 RA is satisfactory and may be installed to provide a desired amount of frictional resistance to rotation of the end car-unit 12 with respect to the shared truck 18 about its truck turning axis 48. Such roller-assisted constant-contact side bearings 64 are installed to provide a preloading of 4,500 pounds in each of the two side bearings 64, carried through the constant-contact friction pad portion 68 of each of the side bearings 64, to produce a frictional resistance to movement of the side bearing support arms 56 with respect to the side bearing foundations 52. This frictional resistance increases with additional load applied to each of the side bearings 64 only until additional weight carried through a respective one of the roller-assisted, constant-contact side bearings 64 moves the elastically-supported, constant-contact friction pad 68 and brings the wear plate 66 into contact with the roller 70 of the side bearing 64, by moving the side bearing support arm 56 a small distance vertically with respect to the side bearing foundation 52. For example, in the above mentioned side bearing a vertical travel of approximately 0.31 inch brings the wear plate 66 into contact with the roller 70 as lateral forces cause the car body 26 of the car unit 12 or 14 with which a male part 36 of an articulating coupling 16 is associated to lean about the roll axis 50. Like the side bearings 58, the side bearings 64 are preferably oriented in a radial mounting position, and they are spaced apart longitudinally of the side bearing foundations 52 from the side bearings 58 to provide sufficient clearance for the adjacent car units to move with respect to each other to change the angle 63 without interference. At the same time, however, the support arms 54 and 56 are laterally separated sufficiently to control any tendency of the car body 26 to lean about the roll axis 50.

As the bodies 26 of a pair of interconnected adjacent car units lean further, increasing amounts of force are transferred toward the respective side bearings 58 and 64 on one side of the shared truck 18, and the loads carried through the side bearings 58 and 64 on the opposite side of the shared truck 18, and eventually the loads carried through the center bearing 46, are reduced accordingly. Nevertheless, the total truck turning moment, that is, the sum of the truck turning moments 59 and 67, required to turn the shared truck 18 with respect to a pair of car units interconnected by such an articulating coupling 16 and supported by a shared truck 18 equipped with side bearings 56 and 64 as described does not increase significantly despite increasing amounts of the weight of each of the car units being transferred to the side bearings rather than being carried through the articulating coupling 16 and by the center bearing 46.

At the same time, the resulting individual truck turning moments 59 and 67 with respect to each of two car units 14 (or a car unit 12 and a car unit 14) interconnected by an articulating coupling 16 and carried jointly by a shared truck 18 equipped with side bearings 58 and 64 as described do not result in either one of the car units having a significantly greater effect of tending to steer the shared truck 18. As a result, changes in the angle 63 about the truck turning axis 48 between interconnected car units, as the multi-unit car 10 either enters or departs from a curved section of the track 11, do not cause the shared truck 18 to exert excessive rail-spreading force.

The described combination of side bearings for interconnected car units of a multi-unit car, providing a lower frictional resistance in side bearings for a car unit associated with the female portion of an articulating coupling supported by a shared truck, and providing a greater amount of frictional resistance in side bearings of a car unit associated with the male portion of such an articulating coupling, with the male part supported by the female portion of the articulating coupling, results in a reduced tendency of such a car to produce high lateral forces on the rail.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An articulated multi-unit railroad car including a plurality of car units for carrying cargo, each car unit having a weight and said car units being arranged end-to-end, at least one of the car units being interconnected with an adjacent one of the car units by an articulating coupling, the car comprising:

(a) first and second adjacent car units, each of said adjacent car units having a respective end;

(b) a shared truck supporting said respective ends of each of said first and second adjacent car units and defining a vertical truck turning axis;

(c) a first part of said articulating coupling being attached to said first adjacent car unit and being supported atop said shared truck in friction producing relationship thereto, said first part carrying a substantial part of the weight of said first car unit to said shared truck, and said shared truck being able to turn with respect to said first part of said articulating coupling about said truck turning axis;

(d) a second part of said articulating coupling being attached to said second adjacent car unit and being supported by said first part of said articulating coupling in friction-producing relationship thereto, said second part carrying a substantial part of the weight of said second car unit to said first part of said articulating coupling;

(e) a first side bearing, disposed between said shared truck and said first car unit, said first side bearing providing not more than a first amount of resistance to turning of said shared truck about said truck turning axis with respect to said first car unit; and (f) a second side bearing, producing a resistance to turning between said shared truck and said second car unit and continuously providing a second amount of resistance to turning of said shared truck about said truck turning axis with respect to said second car unit, said second amount of resistance being greater than said first amount of resistance.

2. The articulated multi-unit railroad car of claim 1 including a center bearing disposed between said first part of said articulating coupling and said shared truck, said second part of said articulating coupling being movable with respect to said first part of said articulating coupling independently of movement of said shared truck with respect to said first part of said articulating coupling, said center bearing providing frictional resistance to turning movement of said shared truck with respect to said first car unit about said truck turning axis, but providing directly only negligible frictional resistance to turning movement of said shared truck with respect to said second car unit about said truck turning axis.

3. The articulated multi-unit railroad car of claim 1 wherein said first side bearing is of a type producing minimal resistance to turning of said shared truck with respect to said first car unit about said truck turning axis while carrying a portion of said weight of said first car unit.

4. The articulated multi-unit railroad car of claim 3 including a pair of said first side bearings located respectively on laterally opposite sides of said shared truck, each of said first side bearings being a roller bearing.

5. The articulated multi-unit railroad car of claim 1 wherein said second side bearing is a constant-contact bearing including means for limiting said second amount of resistance to movement to a predetermined value.

6. The articulated multi-unit railroad car of claim 1 including a pair of said second side bearings located respectively on opposite lateral sides of said shared truck, each of said second side bearings being a roller-assisted constant-contact bearing.

7. The articulated multi-unit railroad car of claim 1 including a center bearing disposed between said first part of said articulating coupling and said shared truck, said first part of said articulating coupling being a female part supported on said shared truck by said center bearing, and said second part of said articulating coupling being a male part mated with said female part, said railroad car including a pair of said first side bearings located respectively on opposite lateral sides of said shared truck and a pair of said second side bearings located respectively on opposite lateral sides of said shared truck.

8. The articulated multi-unit railroad car of claim 7 wherein said center bearing and said first side bearings together produce direct resistance to turning of said shared truck about said turning axis with respect to said first car unit, requiring a first turning moment to turn said truck about said truck turning axis solely with respect to said first car unit, and wherein said second side bearings produce direct resistance to turning of said shared truck about said truck turning axis with respect to said second car unit, requiring a second turning moment to turn said shared truck about said truck turning axis with respect to said second car unit, said first and second truck turning moments being of similar magnitudes.

9. The articulated multi-unit railroad car of claim 8 wherein said center bearing and said first and second side bearings are arranged to accommodate a range of car body lean with respect to the truck bolster, and wherein said first and second truck turning moments remain similar to each other in magnitude throughout said range of car body lean.

10. An articulated multi-unit railroad car including a plurality of car units for carrying cargo, each car unit having a weight and said car units being arranged adjacent one another end-to-end, at least one of said car units being interconnected with an adjacent car unit by an articulating coupling, the car comprising:

(a) first and second adjacent car units, each of said adjacent car units having a respective end;

(b) a shared truck defining a vertical truck turning axis and including a transversely-extending horizontal truck bolster supporting said respective ends of each of said first and second adjacent car units;

(c) a female part of said articulating coupling being attached to said first adjacent car unit, and a center bearing being disposed between said female part of said articulating coupling and said truck bolster in friction-producing relationship, said female part carrying a substantial part of said weight of said first car unit to said truck bolster and said shared truck being able to turn with respect to said first car unit about said truck turning axis;

(d) a male part of said articulating coupling being attached to said second adjacent car unit and mated with said female part of said articulating coupling in friction-producing relationship thereto, said male part carrying a substantial part of said weight of said second car unit to said shared truck through said female part of said articulating coupling;

(e) a pair of side bearing foundations located on said truck bolster laterally spaced apart from each other on opposite sides of said center bearing;

(f) a pair of first side bearing support arms associated with said end of said first car unit;

(g) a pair of second side bearing support arms associated with said end of said second car unit;

(h) a first side bearing having a first resistance to movement disposed between each of said first side bearing support arms and a respective one of said side bearing foundations so as to carry a portion of said weight of said first car unit at least a part of the time; and (i) a second side bearing having a second resistance to movement greater than said first resistance to movement disposed between each of said second side bearing support arms and a respective one of said side bearing foundations so as to carry a portion of said weight of said second car unit at least a part of the time, said center bearing and said first side bearings together producing resistance to turning between said shared truck and said first car unit requiring a first truck turning moment to turn said shared truck solely with respect to said first car unit, and said second side bearings producing resistance to turning between said shared truck and said second car unit requiring a second truck turning moment to turn said shared truck with respect to said second car unit, said first and second truck turning moments being approximately equal to each other when said first and second car units are fully loaded.

* * * * *

UNITED STATES PATENT AND TRADEMARK OFFICE

CERTIFICATE OF CORRECTION

PATENT NO. : 5,207,161

DATED : May 4, 1993

INVENTOR(S) : James D. Pileggi et al.

It is certified that error appears in the above-identified patent and that said Letters Patent is hereby corrected as shown below:

Col. 5, Line 44 Delete "$4\frac{1}{8}$" and insert --$4\frac{5}{8}$-- in place thereof.

Signed and Sealed this

Eighth Day of March, 1994

Bruce Lehman

*Attest:*

BRUCE LEHMAN

*Attesting Officer*

*Commissioner of Patents and Trademarks*